US005584424A

United States Patent [19]

Stava

[11] Patent Number: 5,584,424

[45] Date of Patent: Dec. 17, 1996

[54] WEAPON POUCH AND DISGUISE

[76] Inventor: Scott H. Stava, 340 W. Fallbrook, No. 104, Fresno, Calif. 93711

[21] Appl. No.: 473,115

[22] Filed: Jun. 5, 1995

[51] Int. Cl.[6] ..... A45F 5/00

[52] U.S. Cl. ..... 224/240; 224/666; 224/245; 224/676

[58] Field of Search ..... 224/224, 226, 224/229, 240, 242, 243, 244, 245, 250, 252, 253, 911, 914, 929, 660, 665, 666, 674, 676; 150/101; 190/102; 206/317, 457, 542; D3/215, 218, 222, 223

[56] References Cited

U.S. PATENT DOCUMENTS

| | | | |
|---|---|---|---|
| D. 320,116 | 9/1991 | Levesque | D3/218 |
| D. 343,291 | 1/1994 | Langford . | |
| 2,138,978 | 12/1938 | Meine | 224/911 |
| 4,279,342 | 7/1981 | Van Pelt | 206/542 |
| 4,569,465 | 2/1986 | O'Farrell | 224/224 |
| 4,750,655 | 6/1988 | Barry . | |
| 4,898,310 | 2/1990 | Remington | 224/911 |
| 5,170,919 | 12/1992 | DeSantis et al. | 224/911 |
| 5,294,031 | 3/1994 | Volpei et al. | 224/911 |
| 5,341,975 | 8/1994 | Marinescu | 224/252 |
| 5,353,975 | 10/1994 | Libertucci | 224/224 |
| 5,395,023 | 3/1995 | Naymark et al. | 224/245 |
| 5,495,967 | 3/1996 | Parton | 224/610 |

FOREIGN PATENT DOCUMENTS

| | | | |
|---|---|---|---|
| 421652 | 12/1910 | France | 224/229 |

*Primary Examiner*—Henry J. Recla
*Assistant Examiner*—Gregory M. Vidovich
*Attorney, Agent, or Firm*—Mark D. Miller

[57] ABSTRACT

A convenient and versatile pouch for holding a concealed hand gun disguised as a holder for an electronic device (e.g. a cellular telephone case having a simulated antenna, speaker holes and/or logo on the outside). The pouch is zipper closable and can be locked, and is provided with a belt mount on the back. The inside is provided with at least one adjustable strap which acts as a holster for holding a hand gun or other weapon in place inside. A thong mounted on the inside and passed to the outside through the opening between the zippers may be pulled firmly downward to gain immediate access to the inside of the pouch in an emergency.

14 Claims, 4 Drawing Sheets

WEAPON POUCH AND DISGUISE

BACKGROUND OF THE INVENTION

1. Field of the Invention

The present invention relates to pouches, and in particular to a pouch for holding a concealed weapon which has the disguised outward appearance of a cellular telephone holder.

2. Description of the Prior Art

Hand gun holsters are well known in the art. The most common are waist belt and shoulder holsters. These are widely used by uniformed peace officers and military personnel for carrying hand guns and other weapons. In the old west, it was once widely accepted for private individuals to openly carry hand guns in such holsters. In modern times, permits must be obtained to possess hand guns, and every gun purchaser must undergo considerable background checking as well as a waiting period as part of the purchasing process. Special permits are required for possession of a concealed hand gun. Usually such concealed weapon permits are only issued to law enforcement personnel, although there are situations where private individuals may obtain them as well.

Law enforcement personnel generally desire to carry their service weapons with them while off duty. However, it is cumbersome and somewhat awkward for an off duty peace officer to carry his or her service weapon in a waist or shoulder holster without attracting unnecessary attention. Open display of a hand gun in a holster, even by an off duty peace officer, at best may cause undue anxiety in persons near the officer, and at worst could provoke an undesired confrontation. A holding assembly such as that shown in U.S. Pat. No. 4,750,655 still looks like a holster and will draw attention to itself.

However, because of their special training and ability, it is desirable for off duty peace officers to have immediate access to their weapons in the event that an emergency situation should arise. Thus, there is a need for providing a way for an off duty peace officer to carry a concealed weapon that makes it available for immediate access without drawing attention to the weapon while it is not in use. Since different departments issue different types of hand guns to their law enforcement personnel, it is also desirable to provide a holder that can accommodate one of a variety of different hand guns. When not in use, for proper safety, such a holder should also provide a convenient way to store the officer's weapon so that it cannot easily be mishandled by children or other unsuspecting persons.

SUMMARY OF THE INVENTION

The present invention satisfies each of the above described needs by providing a convenient and versatile pouch for holding a concealed weapon disguised as a cellular telephone or other electronic device holder. The outside of the pouch may have a simulated antenna at one end, and a set of visible simulated speaker holes on the front surface. An optional logo using such words as "data", "cellular", "telephone", "communications", "computer", "organizer" or the like may also be printed on the front or sides of the pouch. The back of the pouch features a mount. The mount may be a clip, loop, strap, an interengaging hook-and-loop (Velcro®) strap, or other similar structure allowing the pouch to be attached to a user's waist belt, belt loop, or pocket, attached to a strap, carried over the shoulder, or otherwise conveniently carried.

Two opposing surfaces are provided on the inside of the pouch which opens along a fabric hinge at the bottom. The mount is on the outside (back) of the upper inside surface providing it with greater stability. The entire upper inside surface is provided with pile or loops for interengaging with corresponding hooks provided on one or more weapon support straps. These adjustable straps may define a holster support for a hand gun, but may provide support for other weapons as well. A conventional holster with interengaging hooks on the back may be used, or a series of different sized straps may be used to hold different sizes and kinds of weapons. The straps may also include separate openings for related items such as ammunition next to the weapon.

The lower inside surface may be left blank, or marked with the off duty law enforcement officer's name, badge number, department, or other appropriate identification information.

The pouch may be closed using a pair of zippers which can come together at any location along a common generally C-shaped track of teeth which run along three of the four sides of the pouch. Each of the zipper tabs has an eye (hole) at its end, and a closable padlock is provided with the pouch. By passing the padlock shackle through the holes in the zipper tabs, the pouch may be locked closed when not in use.

The pouch may be made ready for immediate access by closing (but not locking) the zippers at one of the top corners and allowing an attached thong to extend out from the inside through the gap between the zippers. Pulling down firmly on the thong will rapidly pull both zippers open allowing immediate access to the inside of the pouch.

It is therefore a primary object of the present invention to provide a way for an off duty peace officer to carry a concealed weapon without attracting undue attention.

It is a further important object of the present invention to provide a pouch disguised as a cellular telephone carrying case for holding a concealed weapon.

It is a further important object of the present invention to provide a pouch disguised as a computer organizer or other electronic device carrying case for holding a concealed weapon.

It is a further object of the present invention to provide a disguised pouch for carrying a concealed weapon that makes the weapon available for immediate access without drawing undue attention while not in use.

It is a further important object of the present invention to provide a disguised pouch that can carry one of a variety of different sized hand guns concealed inside.

It is a further important object of the present invention to provide a convenient way to disguise, store and lock a weapon so that it cannot easily be mishandled by children or other unsuspecting persons.

Additional objects of the invention will be apparent from the detailed descriptions and the claims herein.

DETAILED DESCRIPTION OF THE DRAWINGS

Figure 1:
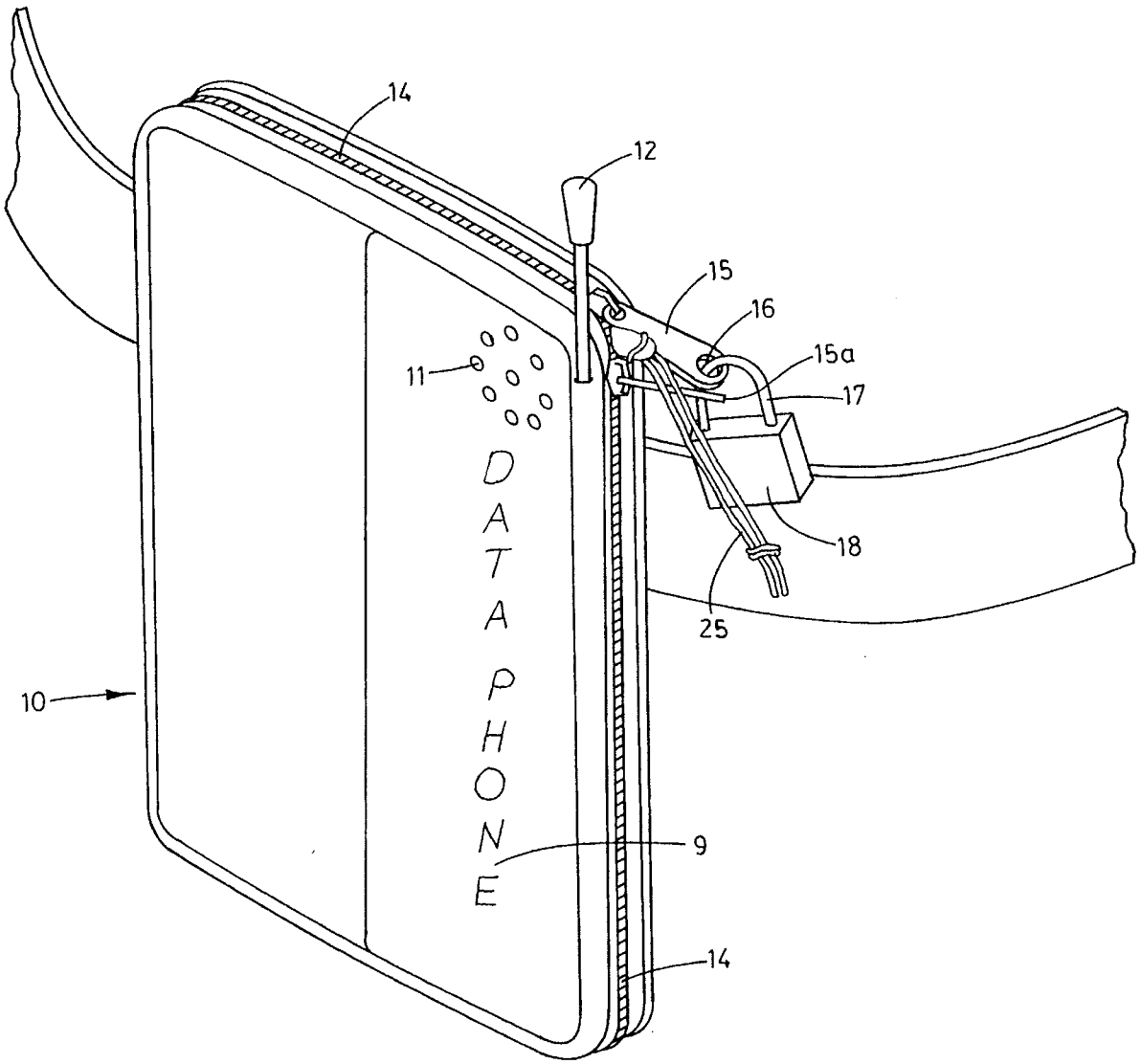
FIG. 1 is a perspective front view of the closed pouch of the present invention.
Figure 2:
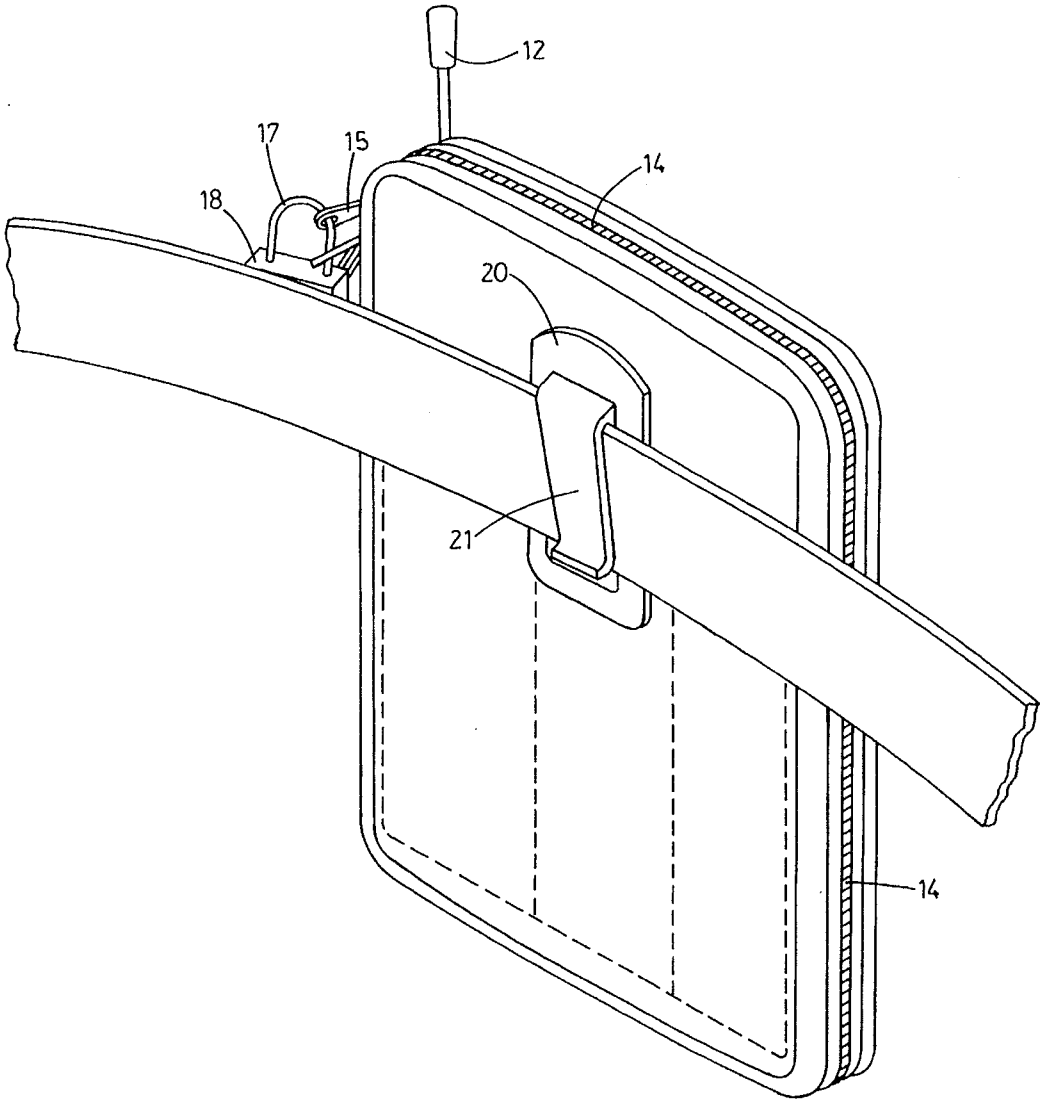
FIG. 2 is a perspective rear view of the closed pouch of the present invention.

Referring to the drawings wherein like reference characters designate like or corresponding parts throughout the several views, and referring particularly to FIGS. 1 and 2 it is seen that the invention includes a pouch 10 having a width dimension that is greater than its depth dimension. A chain of zipper teeth 14 are provided along the edges of pouch 10 separated at the bottom by a fabric hinge 13. A pair of zippers 8 and 8*a* with pull tabs 15 and 15*a* are provided which close pouch 10 along common zipper chain 14. Each pull tab 15, 15*a* is provided with a hole 16 and 16*a* through which the shackle 17 of lock 18 may be passed to lock the pouch closed (see FIG. 1). The outside of pouch 10 may include a simulated antenna 12 and simulated speaker holes 11. An optional logo 9 may also be printed on the outside of pouch 10. The back of pouch 10 includes a support piece 20 sewn or otherwise firmly attached to pouch 10. Support piece 20 includes a mounting means 21 such as a clip, loop, strap, hook-and-loop strap, or the like for attachment to the user's belt, pocket, or other place.

Figure 3:
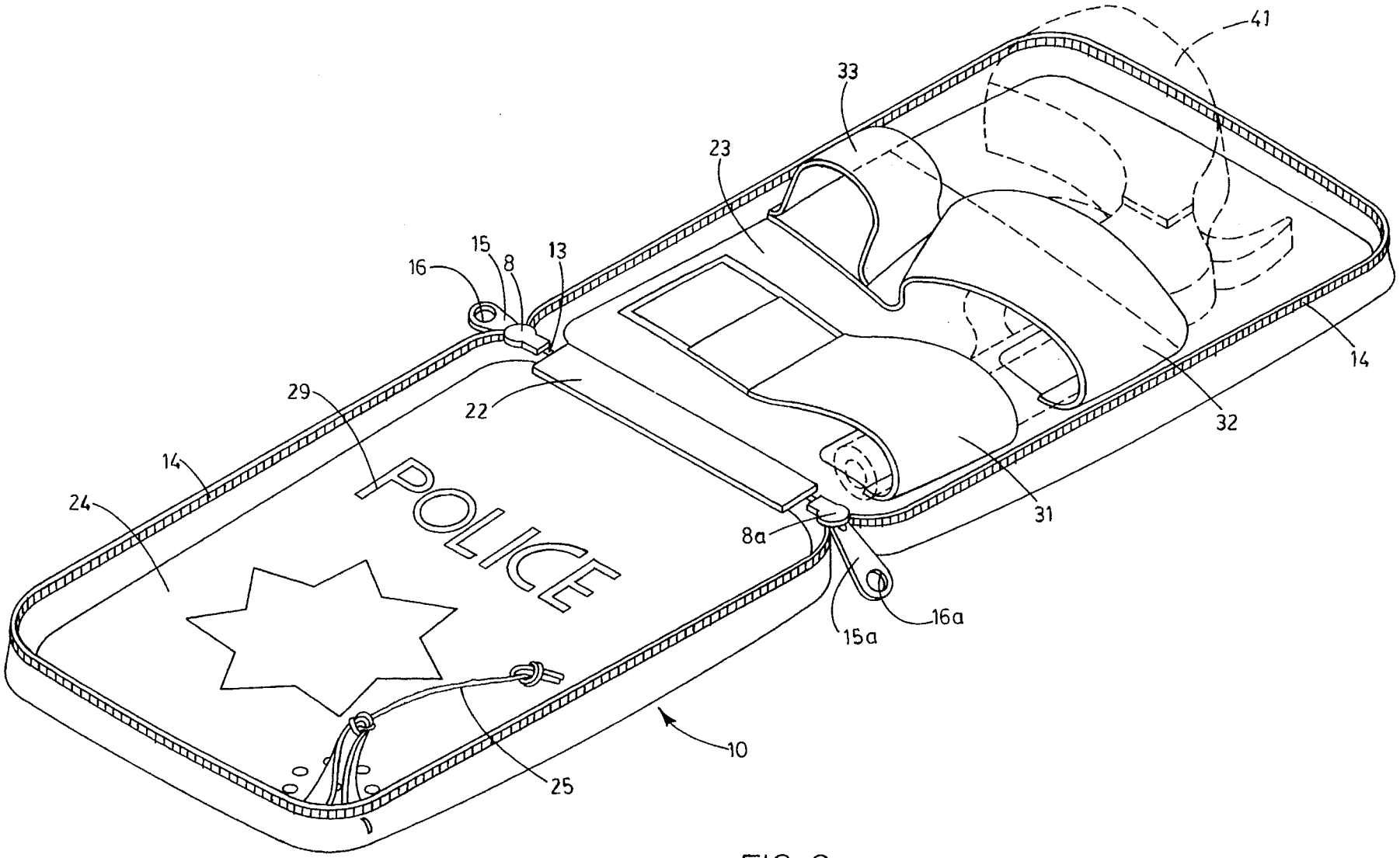
FIG. 3 is a perspective view of the open pouch of the present invention. A typical hand gun is shown in phantom lines.
Figure 4:
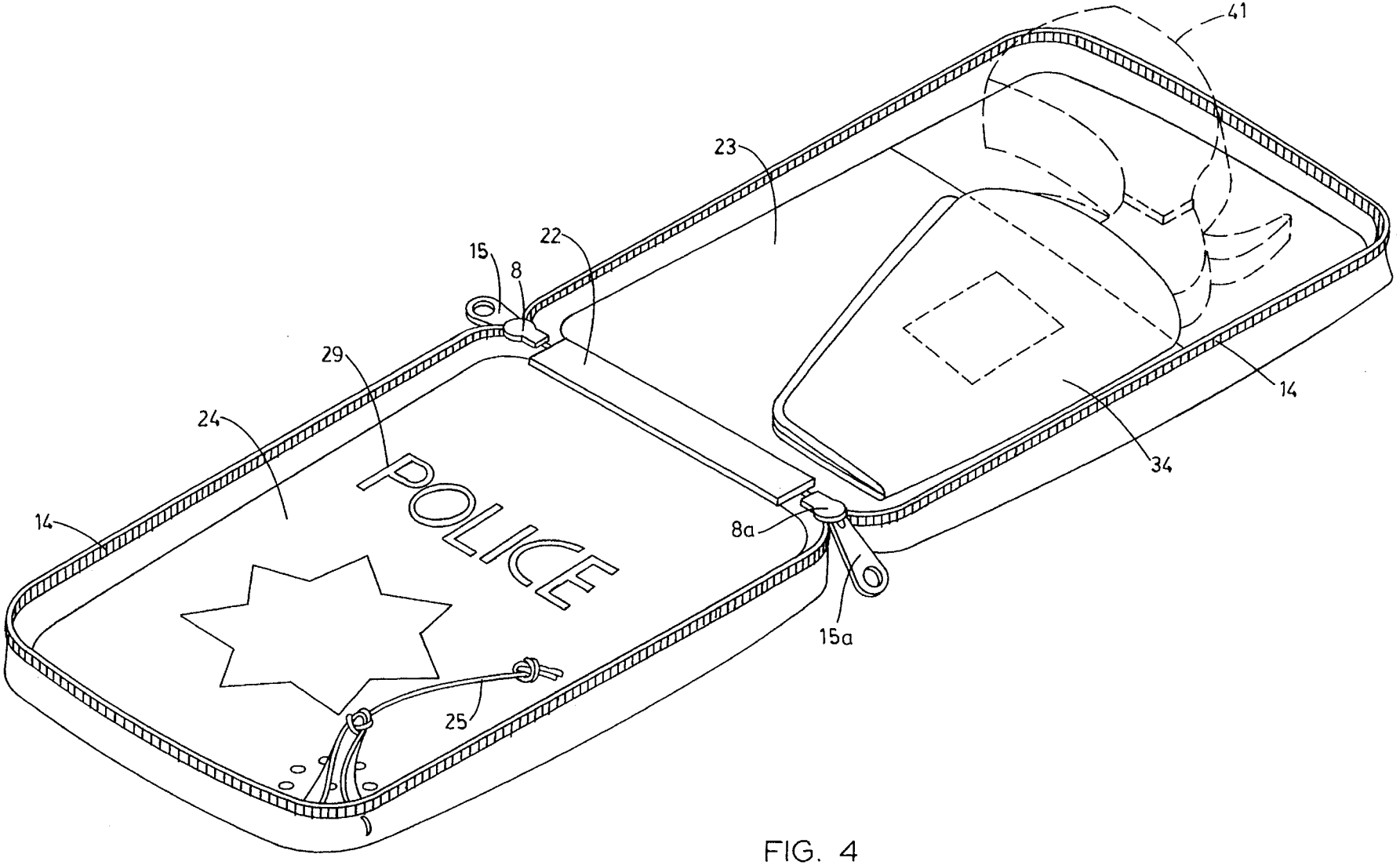
FIG. 4 is a perspective view of an alternative embodiment of the open pouch of the present invention. A typical hand gun is shown in phantom lines.

Referring to FIGS. 3 and 4, it is seen that the inside of pouch 10 includes a separating panel 22 at the bottom above the fabric hinge 13. A thong 25 is firmly attached on the inside of an upper corner of pouch 10. Thong 25 should be allowed to pass to the outside of pouch 10 through the gap between zippers 8 and 8*a* (see FIG. 1). By pulling firmly downward on thong 25, zippers 8 and 8*a* of the unlocked pouch open rapidly allowing immediate access to the inside (note: FIG. 1 shows the pouch locked).

The upper inside surface 23 of pouch 10 is provided with pile or loops for interengagement with corresponding hooks on the backs of detachable straps 31, 32 and holster 34. In the embodiment shown in FIG. 3, a pair of detachable straps 31 and 32 are provided. When holding a hand gun 41, lower strap 31 holds the barrel of the hand gun 41, and upper strap 32 holds the frame and trigger area of hand gun 41. Loop 33 in strap 32 may hold a clip of ammunition, cleaning materials, or the like. Straps 31 and 32 may be moved around on the pile of surface 23 in order to adjust to accommodate any one of a variety of different hand guns or other weapons. Holster 34 (shown in FIG. 4) may be used instead of straps 31 and 32 for different styles of hand guns 41. Identification markings 29 may be provided on the inside of lower surface 24.

DESCRIPTION OF THE PREFERRED EMBODIMENTS

In the preferred embodiment (shown in FIG. 4), the pouch of the present invention is made of leather, vinyl or other similar durable material, and the front and back surfaces are lined on the inside with rigid material such as fiberboard or plastic. Antenna 12 is only a very short metal or plastic rod that is firmly attached to pouch 10 since it is likely that it may be pulled down with thong 25 in the event immediate access is required. Panel 22 should be wide enough to define a space inside pouch 10 sufficient to hold hand gun 41 without any creases or outlines showing on the outside. The shackle of lock 18 should be small enough to fit through the holes 16 and 16*a* of zipper tabs 15 and 15*a*. Lock 18 may be provided with a sheet of hooks adhered on one side to allow convenient carrying against the pile inside pouch 10 when not in use.

Holster 34 should be made of leather, vinyl or other similar material. Holster 34 is provided with hooks on one side for interengagement with the pile of surface 23. However, the hooks could be on surface 23, and the pile provided on holster 34 with equal effectiveness. Alternatively, snaps, buttons or other attachment means may be provided to attach surface 23 to holster 34, although such attachment means would decrease the adjustability of the holster for different guns.

In an alternative embodiment, the antenna 12 and speaker holes 11 may be eliminated leaving simply logo 9 to give the outward appearance of a computer organizer or other electronic device pouch.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A pouch for holding a concealed weapon comprising two hingedly connected closable planar panels defining an interior and exterior of the pouch, the exterior of the first panel having a disguised appearance of a holder for an electronic device, the exterior of the second panel having a mounting means attached thereto, the interior of said second panel having no less than one support piece detachably and adjustably attached thereto for holding the concealed weapon in place inside the pouch, means for closing the perimeters of said first and second panels together, said means for closing comprising at least one zipper extending about at least a portion of the perimeters of said first and second panels and openable from a first end to a second end thereof and a thong fixedly attached to the inside of said first panel and extending through said perimeter closing means adjacent said first end for use in rapidly opening said pouch.

2. The pouch described in claim 1 wherein said interior support piece is in the shape of a holster.

3. The pouch described in claim 1 wherein a second detachable and adjustable interior support strap is provided for holding the weapon.

4. The pouch described in claim 3 wherein at least one of said interior support straps includes an area for holding weapon supplies.

5. The pouch described in claim 1 wherein the exterior disguise of said first panel includes a nonfunctioning antenna.

6. The pouch described in claim 1 wherein the exterior disguise of said first panel includes nonfunctioning speaker holes.

7. The pouch described in claim 1 wherein the exterior disguise of said first panel includes a logo for an electronic device.

8. The pouch described in claim 1 wherein the exterior mounting means of said second panel is in the form of a clip.

9. The pouch described in claim 1 wherein the exterior mounting means of said second panel is in the form of a strap.

10. The pouch described in claim 1 wherein said interior support piece is detachably attached to said second panel using interengaging hooks and loops.

11. The pouch described in claim 3 wherein said interior support straps are detachably attached to said second panel using interengaging hooks and loops.

12. The pouch described in claim 11 wherein the interior surface of said second panel is provided with loops for interengagement with corresponding hooks provided on the surfaces of said interior support straps.

13. The pouch described in claim 1 wherein said closing means is in the form of a pair of zippers, one on each side of said hinge.

14. The pouch described in claim 13 wherein a locking means is provided to lock said pair of zippers together on said pouch in a closed position.

* * * * *